US009816530B2

(12) United States Patent
Okudera et al.

(10) Patent No.: US 9,816,530 B2
(45) Date of Patent: Nov. 14, 2017

(54) SPLINTER SHIELD FOR VACUUM PUMP, AND VACUUM PUMP WITH THE SPLINTER SHIELD

(75) Inventors: Satoshi Okudera, Ichihara (JP); Yoshiyuki Sakaguchi, Urayash (JP)

(73) Assignee: Edwards Japan Limited, Chiba (JP)

( * ) Notice: Subject to any disclaimer, the term of this patent is extended or adjusted under 35 U.S.C. 154(b) by 827 days.

(21) Appl. No.: 13/884,740

(22) PCT Filed: Jul. 28, 2011

(86) PCT No.: PCT/JP2011/067317
§ 371 (c)(1),
(2), (4) Date: May 10, 2013

(87) PCT Pub. No.: WO2012/070282
PCT Pub. Date: May 31, 2012

(65) Prior Publication Data

US 2013/0230384 A1 Sep. 5, 2013

(30) Foreign Application Priority Data

Nov. 24, 2010 (JP) ..... 2010-261624

(51) Int. Cl.
*F04D 19/04* (2006.01)
*F04D 29/70* (2006.01)
(Continued)

(52) U.S. Cl.
CPC ..... *F04D 29/70* (2013.01); *F04B 37/02* (2013.01); *F04B 37/14* (2013.01); *F04B 37/16* (2013.01);
(Continued)

(58) Field of Classification Search
CPC ..... F04D 19/04; F04D 19/042; F04D 29/644; F04D 29/701; F04D 29/70
See application file for complete search history.

(56) References Cited

U.S. PATENT DOCUMENTS 4,177,930 A * 12/1979 Crisci ..... B65D 43/0212 220/284
4,443,897 A * 4/1984 Austin ..... E03C 1/26 4/291
(Continued)

FOREIGN PATENT DOCUMENTS

CN 2084507 U 9/1991
CN 1434215 A 8/2003
(Continued)

OTHER PUBLICATIONS

PCT International Search Report for corresponding PCT Application No. PCT/JP2011/067317, dated Nov. 1, 2011.
(Continued)

*Primary Examiner* — Woody Lee, Jr.
*Assistant Examiner* — Joshua R Beebe
(74) *Attorney, Agent, or Firm* — Theodore M. Magee; Westman, Champlin & Koehler, P.A.

(57) ABSTRACT

The present invention provides a splinter shield for a vacuum pump, capable of reducing costs of the splinter shield by obtaining a single sheet of splinter shield having a required strength, in which fastening strength to a fixing groove is enhanced to prevent the splinter shield from bending toward the inside of a pump and coming into contact with equipment inside the pump when air rushes into the pump through an inlet port and to prevent the splinter shield from falling. Furthermore, attachment and removal of the splinter shield with respect to the inlet port are facilitated.

The present invention is a splinter shield for a vacuum pump in which a rim formed in a circumferential edge portion of the splinter shield is inserted into a fixing groove that is provided in a concave manner in an inner circumferential portion of an inlet port, and the splinter shield is provided in a tensioned manner to the inlet port by pushing a retaining
(Continued)

ring into the fixing groove, wherein locking parts that are locked into the retaining ring at a plurality of sections in the rim are provided in a standing manner at substantially right angles to the rim.

3 Claims, 7 Drawing Sheets

(51) Int. Cl.

| | |
|---|---|
| ***F04B 37/02*** | (2006.01) |
| ***F04B 37/14*** | (2006.01) |
| ***F04B 37/16*** | (2006.01) |
| ***F04D 29/64*** | (2006.01) |
| ***F04D 27/02*** | (2006.01) |

(52) U.S. Cl.
CPC ..... *F04D 19/04* (2013.01); *F04D 19/042* (2013.01); *F04D 27/0292* (2013.01); *F04D 29/644* (2013.01); *F04D 29/701* (2013.01)

(56) References Cited

U.S. PATENT DOCUMENTS

| | | | | |
|---|---|---|---|---|
| 4,535,889 | A * | 8/1985 | Terauds | B65D 43/0212 206/527 |
| 5,406,754 | A * | 4/1995 | Cosby | E04D 13/076 52/12 |
| 5,528,618 | A * | 6/1996 | Schlie | F04D 19/042 372/58 |
| 5,709,528 | A * | 1/1998 | Hablanian | F04D 19/04 415/121.2 |
| 6,106,223 | A * | 8/2000 | Leyshon | F04D 19/04 415/116 |
| 2003/0017047 | A1* | 1/2003 | Shiokawa | F04D 19/042 415/90 |
| 2006/0110271 | A1* | 5/2006 | Klabunde | F04D 29/023 417/423.4 |
| 2007/0058342 | A1 | 3/2007 | Wu et al. | |
| 2010/0215532 | A1 | 8/2010 | Tsutsui | |

FOREIGN PATENT DOCUMENTS

| | | | |
|---|---|---|---|
| CN | 1933709 | A | 3/2007 |
| EP | 1669608 | A2 | 6/2006 |
| JP | H11230087 | A | 8/1999 |
| JP | H11247790 | A | 9/1999 |
| JP | 2003003988 | A | 1/2003 |
| JP | 2006299968 | A | 11/2006 |
| JP | 2009209827 | A | 9/2009 |
| JP | 2010116926 | A | 5/2010 |
| WO | 2008139614 | A1 | 11/2008 |

OTHER PUBLICATIONS

PCT International Written Opinion for corresponding PCT Application No. PCT/JP2011/067317, dated Nov. 1, 2011.
Chinese Office Action and Chinese Search Report dated Mar. 25, 2015 for corresponding Chinese Application No. 201180055012.9.
European Search Report dated Mar. 25, 2014 for corresponding European Patent Application No. 11843290.5.

* cited by examiner

SPLINTER SHIELD FOR VACUUM PUMP, AND VACUUM PUMP WITH THE SPLINTER SHIELD

BACKGROUND OF THE INVENTION

Field of the Invention

The present invention relates to a splinter shield for a vacuum pump and a vacuum pump having the splinter shield. More particularly, the present invention relates to a splinter shield for a vacuum pump, which has a sufficiently enhanced fastening strength to a fixing groove and is capable of sufficiently preventing the splinter shield itself from bending toward the inside of a vacuum pump when air rushes into the pump through an inlet port, and further relates to a vacuum pump having such splinter shield.

Description of the Related Art

In a conventional high speed rotary vacuum pump such as a turbomolecular pump, a splinter shield for preventing the entry of foreign matters is mounted on an inlet port provided inside a flange part of a casing upper end part in order to prevent the entry of foreign matters to a rotator inside pump equipment through the inlet port. When the flange part is of ISO standards, the splinter shield cannot be screwed and fixed to the inlet port due to a space-related problem. In addition, without a predetermined strength, the splinter shield might bend toward the inside of the pump upon rush of air into the pump through the inlet port and come into contact with the equipment inside the pump, such as a rotary vane, causing damage to the pump. Therefore, the splinter shield needs to have a predetermined strength.

Under such circumstances, there exists a first conventional technology, shown in FIGS. 6 to 8A and 8B, for example, that has a splinter shield for a vacuum pump and a structure for fixing the splinter shield to an inlet port. FIG. 6 shows a wire net 1 with a circumferential edge rim 1*a* formed along a circumferential edge portion of the wire net. FIG. 7 shows a metal reinforcing plate 2 having a circumferential edge plate part 2*a* of a circumferential edge portion and a cross-shaped rib portion 2*b* disposed as a crosspiece within the circumferential edge plate part 2*a*. The splinter shield for a vacuum pump is obtained by superposing and appropriately spot-welding the wire net 1 and the reinforcing plate 2, which are formed separately, into an integrated composite part.

FIGS. 8A and 8B each show a structure for fixing the splinter shield 3, a composite part of the wire net 1 and the reinforcing plate 2, to an inlet port 4. An annular fixing groove 7 is provided in a concave manner inside a flange part 6 of an upper part of a casing 5 in the vacuum pump. The splinter shield 3 configured by the composite part described above has its superposed part, configured by the circumferential edge rim 1*a* and the circumferential edge plate part 2*a*, inserted in the fixing groove 7 and an annular retaining ring 8 pushed thereto. The splinter shield 3 is then fixed to the inlet port 4. The vacuum pump that is located immediately below the splinter shield 3 fixed to the inlet port 4 is equipped with a rotary vane 10 provided in a spread manner in a rotor 9 (FIG. 8A).

Further, FIG. 9 shows a second conventional technology that has a splinter shield for a vacuum pump and a structure for fixing the splinter shield to an inlet port. In this conventional technology, a splinter shield 11 for a vacuum pump is realized with a single part, and a brim part of the splinter shield 11 is tilted upward at a predetermined angle to form an inclined brim part 11*a*. A height h of the inclined brim part 11*a* corresponds to the insertion width of the fixing groove 7 (a vertical width in FIG. 9). Pushing this inclined brim part 11*a* into the fixing groove 7 without using a retaining ring can tightly couple the inclined brim part 11*a* and the fixing groove 7 to each other, thereby fixing the splinter shield 11 to the inlet port 4.

When air rushes into the pump through the inlet port 4, the inclined brim part 11*a* tends to deform in a manner shown by a virtual line in FIG. 9, wherein an upper edge part of the inclined brim part 11*a* comes into tight contact with an upper surface of the fixing groove 7, preventing the splinter shield 11 from falling and bending toward the inside of the pump.

For example, the following vacuum pump is known as a conventional technology relating to the vacuum pump described above. In this conventional technology, a casing base part is screwed and fixed to a lower flange part of a base configuring a substrate of a vacuum pump of turbomolecular pump type. A rotor is attached to an upper end of a rotating shaft of a casing central part. The rotor is provided with rotary vanes in a radially spread manner at certain intervals, the rotary vanes being directed toward an inner circumference of a casing. On the other hand, multiple steps of ring-shaped spacers are disposed in a stacked manner on the inner circumference side of the casing, and a stationary vane having its base part held between the spacers is provided in a manner as to extend toward the rotor. A turbo mechanism is configured by alternately superposing the rotary vanes and the stationary vanes from the inside and the outside. The splinter shield has an annular plate (ring) around the rim thereof so as to be mounted on an inlet port. This annular ring part is held between a step part of a casing upper part and the top spacer and then held by the inlet port (see Japanese Patent Application Publication No. H11-247790, for example).

The first conventional technology generates high costs because the splinter shield is formed with the composite part obtained by superposing the wire net and the reinforcing plate formed separately. In the structure for fixing the splinter shield to the inlet port, a flat section in which the circumferential edge rim of the wire net and the circumferential edge plate part of the reinforcing plate are superposed is inserted into the fixing groove, and then the retaining ring is pushed into the fixing groove. This easily results in inadequacy of fastening strength of the splinter shield to the fixing groove, and the splinter shield might bend more toward the inside of the pump, depending on the force of air rushing into the pump through the inlet port. Consequently, the splinter shield might come into contact with the equipment inside the pump, and the inserted part might be released from the fixing groove, dropping the splinter shield.

In the second conventional technology, the height h of the inclined brim part corresponds to the insertion width of the fixing groove, and pushing the inclined brim part into the fixing groove can tightly couple the inclined brim part and the fixing groove to each other and fix the splinter shield to the inlet port. Thus, it is difficult to manage the inclination angle and the height h of the inclined brim part, and it is extremely difficult to press the inclined brim part into the fixing groove to tightly couple the inclined brim part and the fixing groove to each other. In this regard, the second conventional technology generates high costs.

In the conventional technology described in Japanese Patent Application Publication No. H11-247790, multiple steps of ring-shaped spacers are disposed in a stacked manner on the inner circumference side of the casing, and the splinter shield is fixed to the inlet port by having the annular ring part between the top spacer and the step part of the casing upper part. Therefore, removing the splinter shield in order to replace the splinter shield requires a troublesome work of removing the screws fixing the casing based part to the lower flange part of the base.

A technical problem to be solved, therefore, is to reduce costs of a splinter shield by obtaining a single sheet of splinter shield having a required strength and enhanced fastening strength to a fixing groove, to prevent the splinter shield from bending toward the inside of a pump and coming into contact with equipment inside the pump when air rushes into the pump through an inlet port, so that the splinter shield does not fall, and to facilitate attachment and removal of the splinter shield with respect to the inlet port. An object of the present invention is to solve this problem.

SUMMARY OF THE INVENTION

The present invention was contrived in order to achieve the object described above, and an invention described in claim 1 provides a splinter shield for a vacuum pump in which a rim formed in a circumferential edge portion of the splinter shield is inserted into a fixing groove that is provided in a concave manner in an inner circumferential portion of an inlet port of the vacuum pump, and the splinter shield is provided in a tensioned manner to the inlet port by pushing a retaining ring into the fixing groove, wherein locking parts that are locked into the retaining ring at a plurality of sections in the rim are provided in a standing manner at substantially right angles to the rim.

According to this configuration, the locking parts are provided in a plurality of sections in the rim in such a manner as to stand in a standing manner at substantially right angles to the rim and locked into the retaining ring so that the fastening strength of the splinter shield to the fixing groove becomes sufficiently strong. Therefore, the splinter shield can be prevented from bending toward the inside of the pump and falling when air rushes into the pump through the inlet port.

An invention described in claim 2 provides, in the invention described in claim 1, a splinter shield for a vacuum pump, having a wire netting portion and a rib portion for reinforcement disposed as a crosspiece within the rim, wherein the wire netting portion and the rib portion are integrally formed with a single sheet member.

According to this configuration, the strength of the splinter shield itself can be enhanced by integrally forming the wire netting portion and the rib portion for reinforcement. Therefore, the splinter shield can be prevented, more certainly, from bending toward the inside of the pump when air rushes into the pump through the inlet port.

An invention described in claim 3 provides a vacuum pump having the splinter shield for a vacuum pump according to claim 1 or 2.

According to this configuration, the splinter shield providing sufficiently strong fastening strength with respect to the fixing groove and having a reinforced strength is provided in a tensioned manner to the inlet port. Thus, the splinter shield can certainly be prevented from bending toward the inside of the pump when air rushes into the pump through the inlet port.

The invention described in claim 1 can sufficiently enhance the fastening strength of the splinter shield with respect to the fixing groove. As a result, the splinter shield can be prevented from bending toward the inside of the pump, coming into contact with the equipment inside the pump and falling when air rushes into the pump through the inlet port. In addition, because this invention is not configured to push the locking parts into the fixing groove to tightly couple the locking parts and the fixing groove to each other, the locking parts being provided in a standing manner at substantially right angles to the rim, the invention has an advantage of easy attachment and removal of the splinter shield with respect to the inlet port.

In addition to the effect of the invention described in claim 1, an advantage of the invention described in claim 2 is that the splinter shield alone can be provided with a required strength without a composite part obtained by superposing a wire net and a reinforcing plate which are formed separately, accomplishing a reduction of the costs.

An advantage of the invention described in claim 3 is that the splinter shield can certainly be prevented from bending toward the inside of the pump and coming into contact with the equipment inside the pump such as rotary vanes when air rushes into the pump through the inlet port, because the strong splinter shield having a sufficiently enhanced fastening strength with respect to the fixing groove is provided in a tensioned manner to the inlet port.

BRIEF DESCRIPTION OF THE DRAWINGS

FIG. 3 is an enlarged view of locking parts of the splinter shield shown in FIG. 2, wherein FIG. 3A is a perspective view showing the locking parts from the front and FIG. 3B is a perspective view showing the locking parts from the side;

FIG. 8 is a diagram showing a structure in which the splinter shield is fixed to the inlet port according to the same conventional technology, wherein FIG. 8A is a traverse cross-sectional diagram showing the entire structure and FIG. 8B is a traverse cross-sectional diagram showing the enlargement of a section where the splinter shield is fastened to a fixing groove shown in FIG. 8A.

DESCRIPTION OF THE PREFERRED EMBODIMENTS

In order to accomplish the object of reducing costs of a splinter shield by obtaining a single sheet of splinter shield having a required strength and enhanced fastening strength to a fixing groove, preventing the splinter shield from bending toward the inside of a pump and coming into contact with equipment inside the pump when air rushes into the pump through an inlet port, so that the splinter shield does not fall, and facilitating attachment and removal of the splinter shield with respect to the inlet port, the present invention realizes a splinter shield for a vacuum pump in which a rim formed in a circumferential edge portion of the splinter shield is inserted into a fixing groove that is provided in a concave manner in an inner circumferential portion of an inlet port of the vacuum pump, and the splinter shield is provided in a tensioned manner to the inlet port by pushing a retaining ring into the fixing groove, wherein locking parts that are locked into the retaining ring at a plurality of sections in the rim are provided in a standing manner at substantially right angles to the rim.

Embodiment 1

Figure 8:
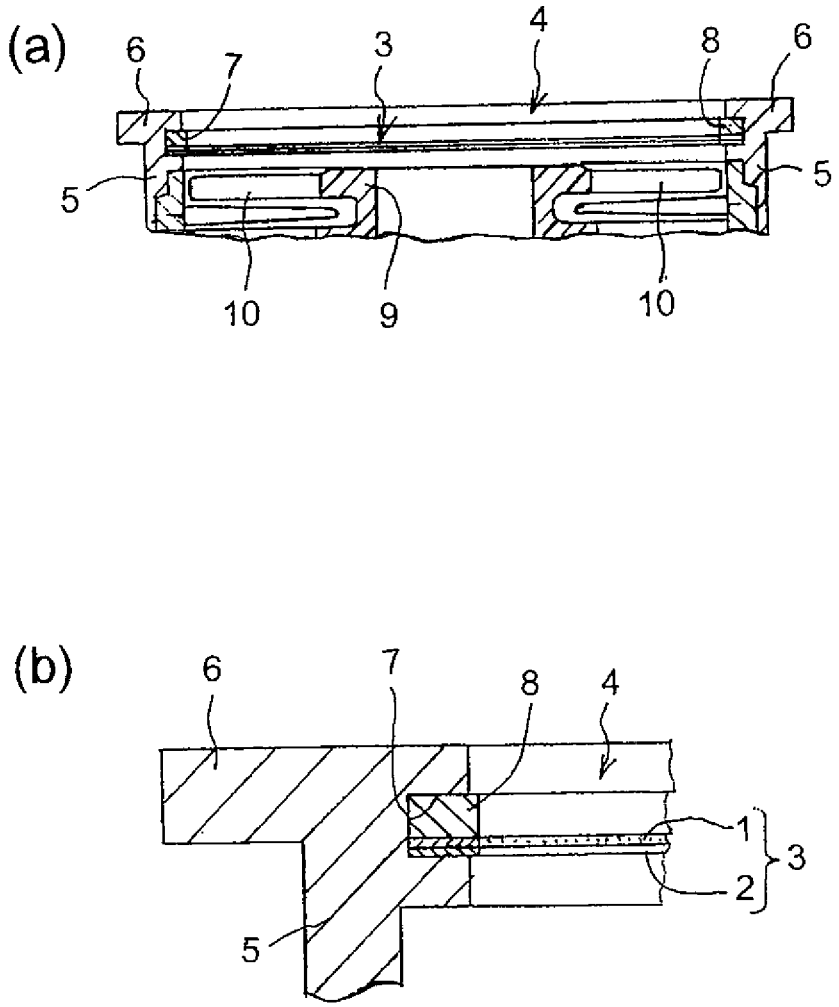
Figure 9:
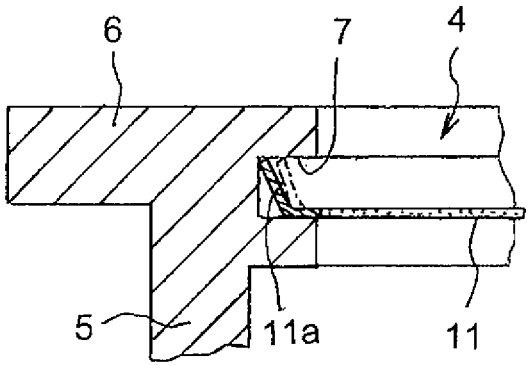
FIG. 9 is a traverse cross-sectional diagram showing the section where the splinter shield is fastened to the fixing groove according to the second conventional technology.

A preferred embodiment of the present invention is described hereinafter with reference to FIGS. 2 to 5. Note that, in FIGS. 4 and 5, the same reference numerals are applied to the components same as or equivalent to those shown in FIGS. 8A and 8B, and hence the overlapping description is omitted accordingly.

Figure 1:
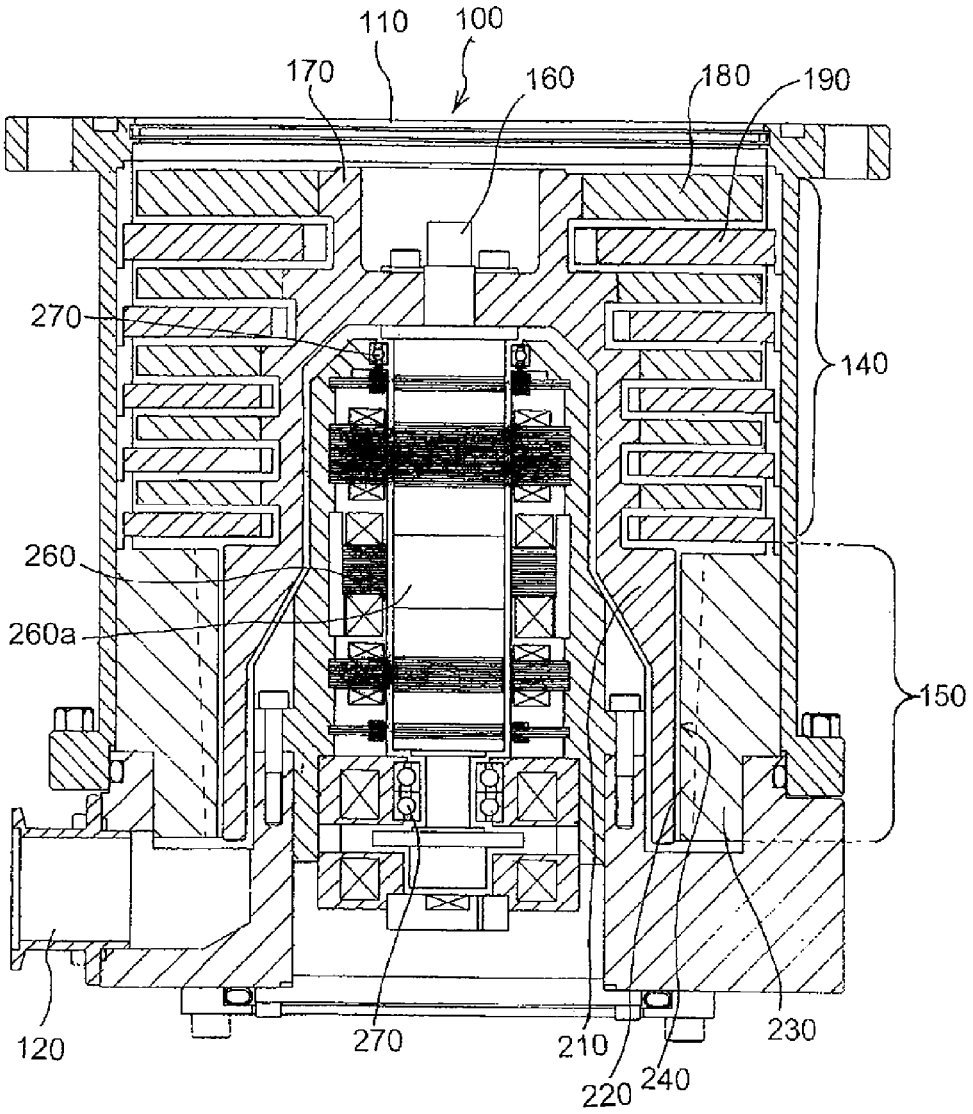
FIG. 1 is a vertical cross-sectional diagram of a vacuum pump shown as an embodiment of the present invention.

FIG. 1 is a vertical cross-sectional diagram of a vacuum pump according to the present invention.

In FIG. 1, a vacuum pump 100 is provided with a housing 130 having an inlet port 110 and an exhaust port 120. The inside of the housing 130 is provided with a turbomolecular pump part 140 at an upper part, a cylindrical thread groove pump part 150 at a lower part, and an exhaust path 240 that passes through the turbomolecular pump part 140 and the thread groove pump part 150 to connect the inlet port 110 and the exhaust port 120 with each other.

More specifically, the exhaust path 240 alternately connects the gap between an outer circumferential surface of an after-mentioned rotor 170 of the turbomolecular pump part 140 and an inner circumferential surface of the housing 130 that face each other and the gap between an outer circumferential surface of an after-mentioned cylinder rotor 210 of the thread groove pump part 150 and an inner circumferential surface of a stator 230, connects a gap upper end on the turbomolecular pump part 140 side to the inlet port 110, and connects a gap lower end on the thread groove pump part 150 side to the exhaust port 120.

The turbomolecular pump 140 is configured by combining a plurality of rotary vanes 180, which are provided in a protruding manner on the outer circumferential surface of the aluminum alloy rotor 170 fixedly provided to a rotating shaft 160, and a plurality of stationary vanes 190, which are provided in a protruding manner on the inner circumferential surface of the housing 130.

The thread groove pump part 150 is configured by the cylinder rotor 210 and the stator 230. The cylinder rotor 210 is located at a lower end part of the rotor 170 in the turbomolecular pump part 140. The stator 230 faces the outer circumference of the cylinder rotor 210, with a small gap therebetween, and is installed with a thread groove 220 that forms a part of the exhaust path 240 along with the small gap. The thread groove 220 is formed so as to become gradually shallower toward the bottom. The stator 230 is fixed to an inner surface of the housing 130. A lower end of the thread groove 220 is connected to the exhaust port 120 on the lowermost stream side of the exhaust path 240.

A motor rotor 260*a* of a high-frequency motor 260, such as an induction motor, provided inside a motor housing 250, is fixed to a middle part of the rotating shaft 160. The rotating shaft 160 is supported by a magnetic bearing and provided with upper and lower protective bearings 270.

Operations of the vacuum pump shown in FIG. 1 are described next. Gas that flows in through the inlet port 110 as a result of driving the high-frequency motor 260 is in a molecular flow state or an interflow state similar thereto. The actions of the rotating rotary vanes 180 of the turbomolecular pump part 140 and the stationary vanes 190 protruding from the housing 130 apply a downward momentum to gas molecules of the gas, whereby the gas is moved toward the downstream side while being compressed by the high-speed rotation of the rotary vanes 180.

The gas that moves while being compressed is guided by the rotating cylinder rotor 210 and the thread groove 220 in the thread groove pump part 150, the thread groove 220 forming the small gap together with the stator 230 and becoming gradually shallow toward a downstream of the stator 230. The gas then flows through the exhaust path 240 while being compressed into a viscous flow state, and is then discharged from the exhaust port 120.

Figure 2:
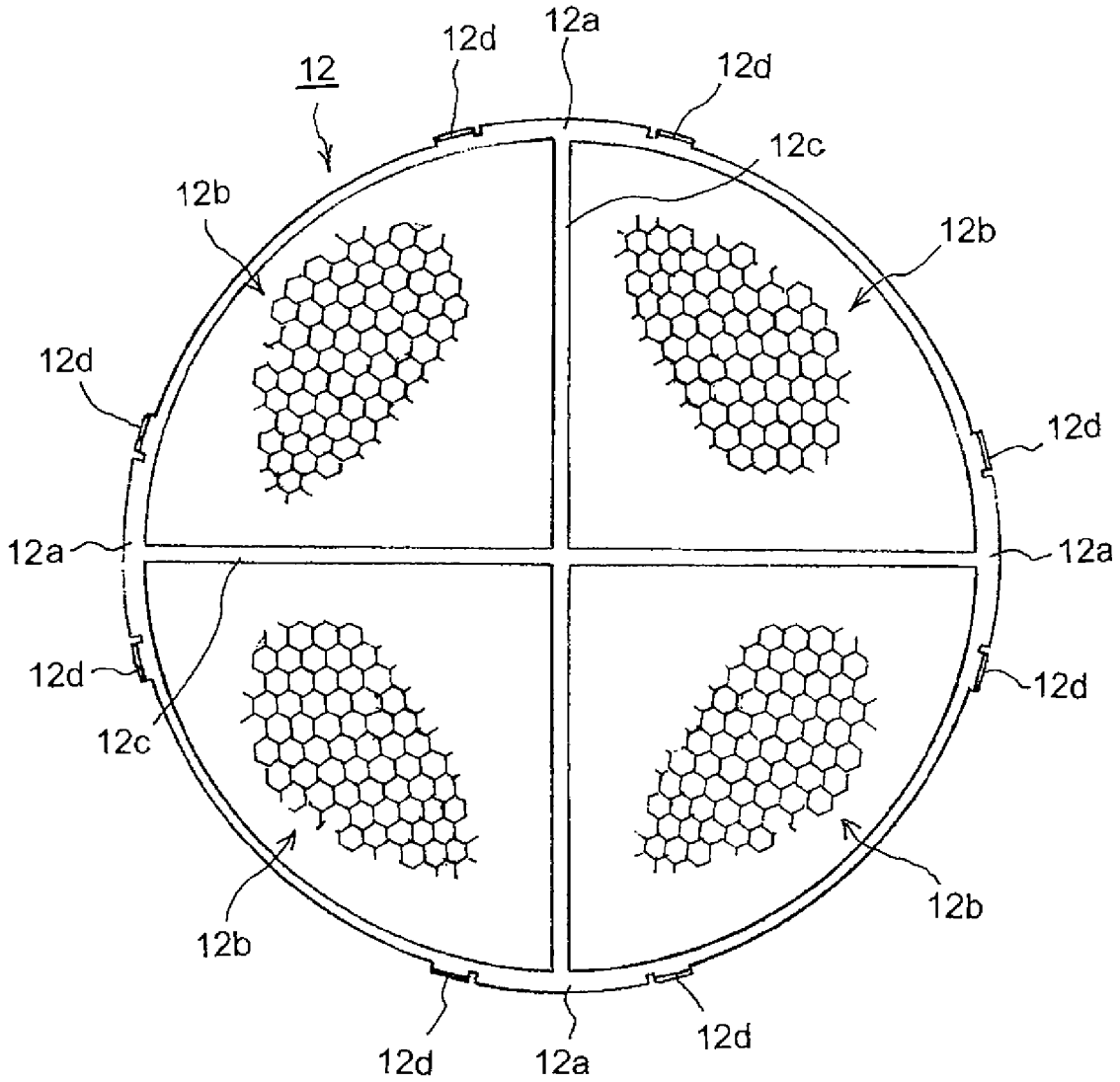
FIG. 2 is a plan view of a splinter shield that is applied to a splinter shield for a vacuum pump according to the embodiment of the present invention.
Figure 3:
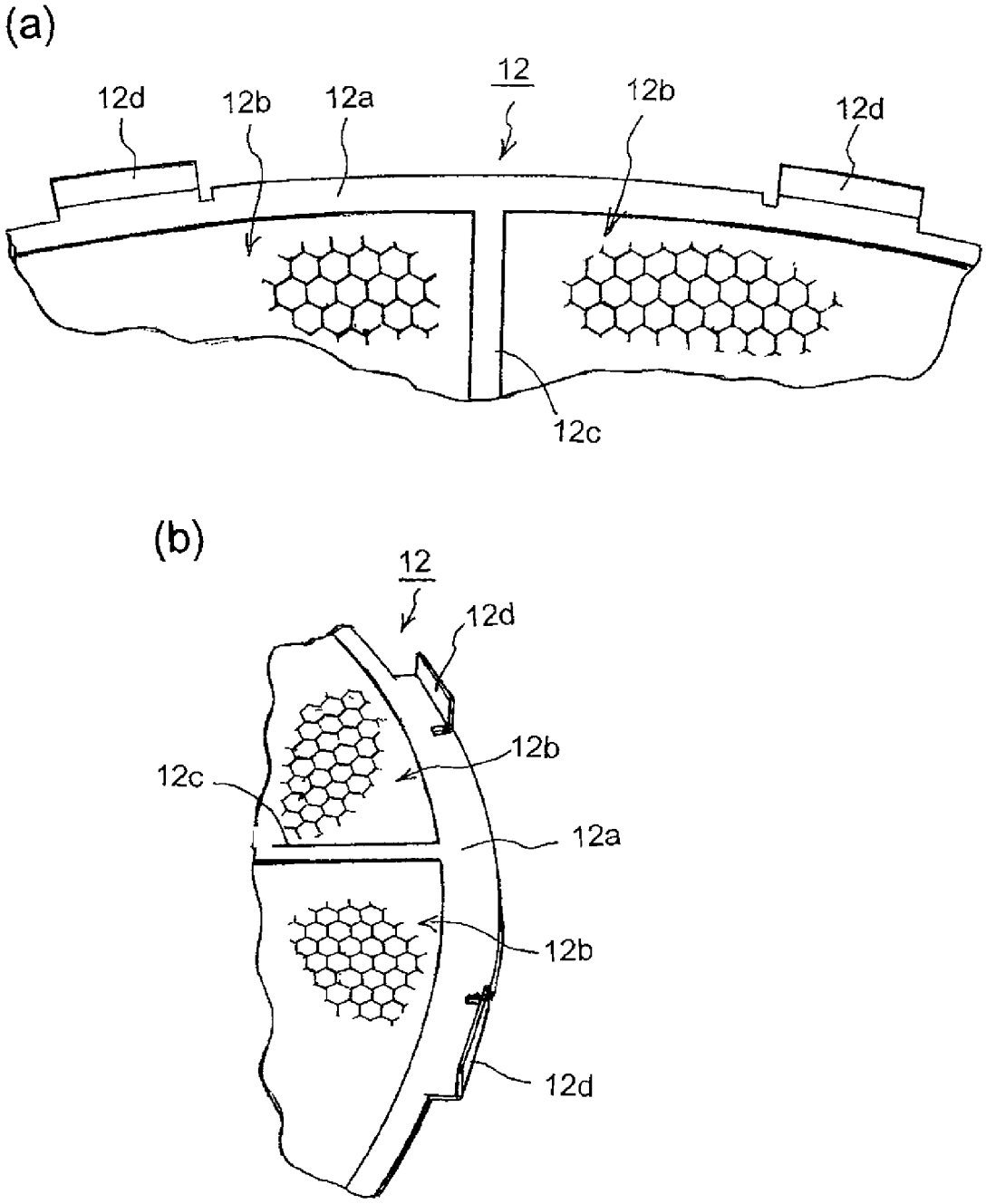
Figure 4:
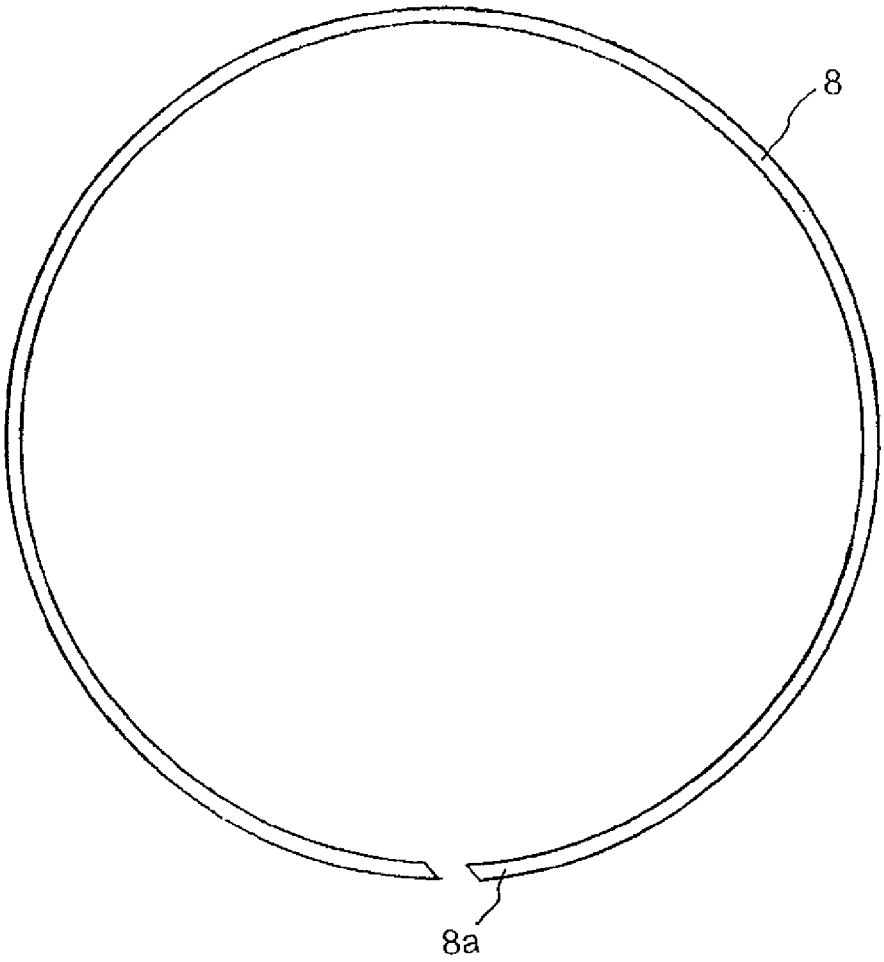
FIG. 4 is a plan view of a retaining ring used for fastening the splinter shield of FIG. 2 to an inlet port.

A configuration of a splinter shield for a vacuum pump according to the present embodiment is described next. In FIGS. 2 to 4, a splinter shield 12 of the present embodiment is formed as a single piece of sheet by etching a single metal plate, wherein a wire netting portion 12*b* having a rim 12*a* in its circumferential edge portion and a cross-shaped rib portion 12*c* for reinforcement disposed as a crosspiece within the rim 12*a* are integrated. The wire netting portion 12*b* is perforated with a plurality of hexagonal holes in the form of, for example, a honeycomb.

Locking parts 12*d* that are locked into an after-mentioned retaining ring are provided in a plurality of sections in the rim 12*a* so as to stand in a standing manner at substantially right angles to the rim 12*a*, as shown in FIGS. 3A and 3B. The locking parts 12*d* are formed by forming projections that protrude outward from the rim 12*a* and then folding the projections at substantially right angles to the rim 12*a* at the time of the etching process described above. As shown in FIG. 2, four pairs of the locking parts 12*d* are formed at equal intervals in a circumferential edge portion of the splinter shield 12.

FIG. 4 shows a retaining ring 8. A part of the retaining ring 8 is cut out into a notch 8*a*, and an appropriate size of gap is formed therein.

Figure 5:
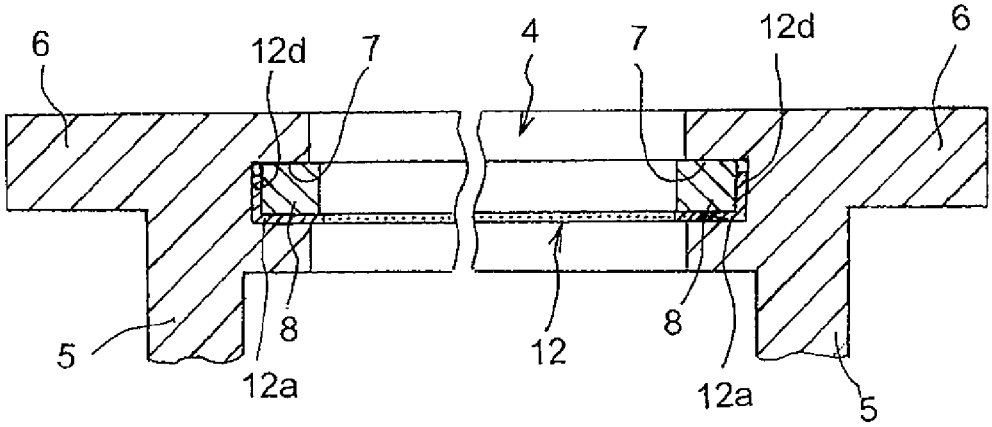
FIG. 5 is a traverse cross-sectional diagram partially showing a structure in which the splinter shield shown in FIG. 2 is fixed to the inlet port.
Figure 6:
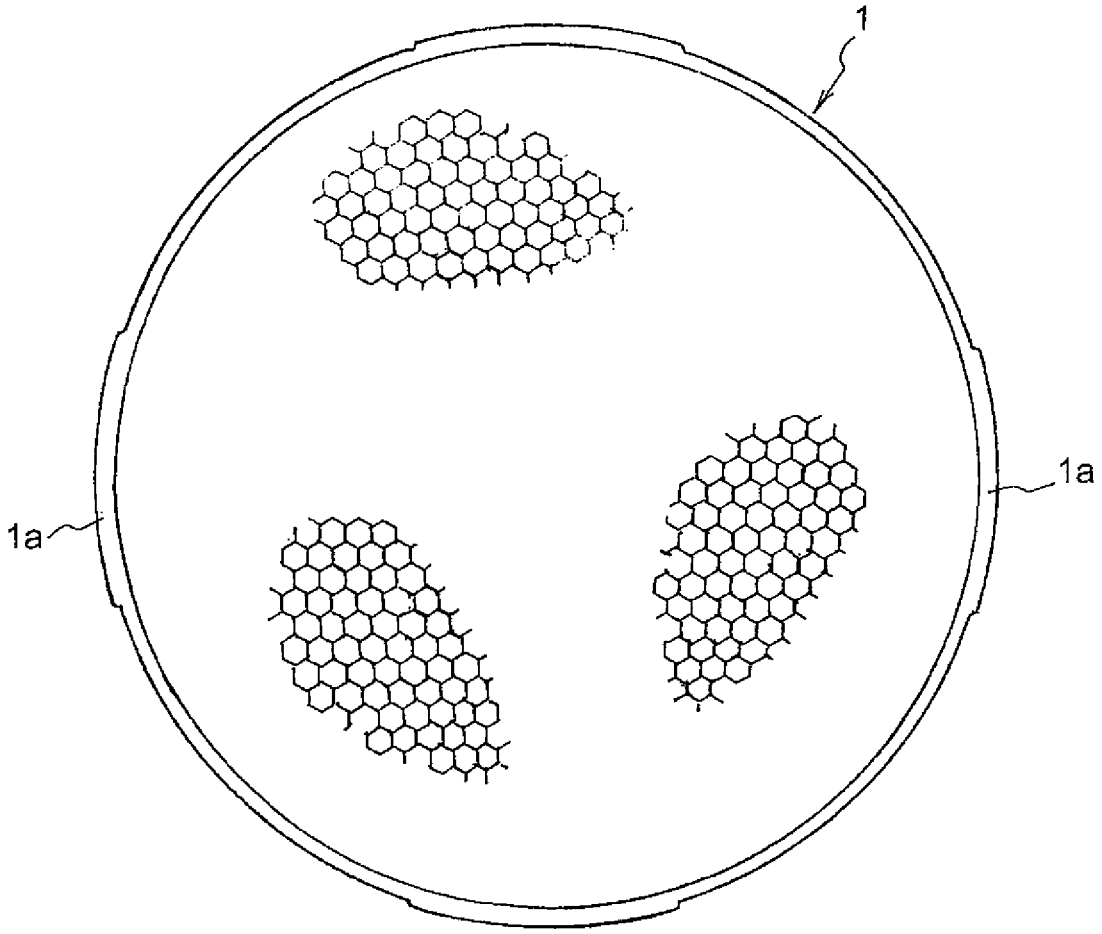
FIG. 6 is a plan view of a wire net according to the second conventional technology.
Figure 7:
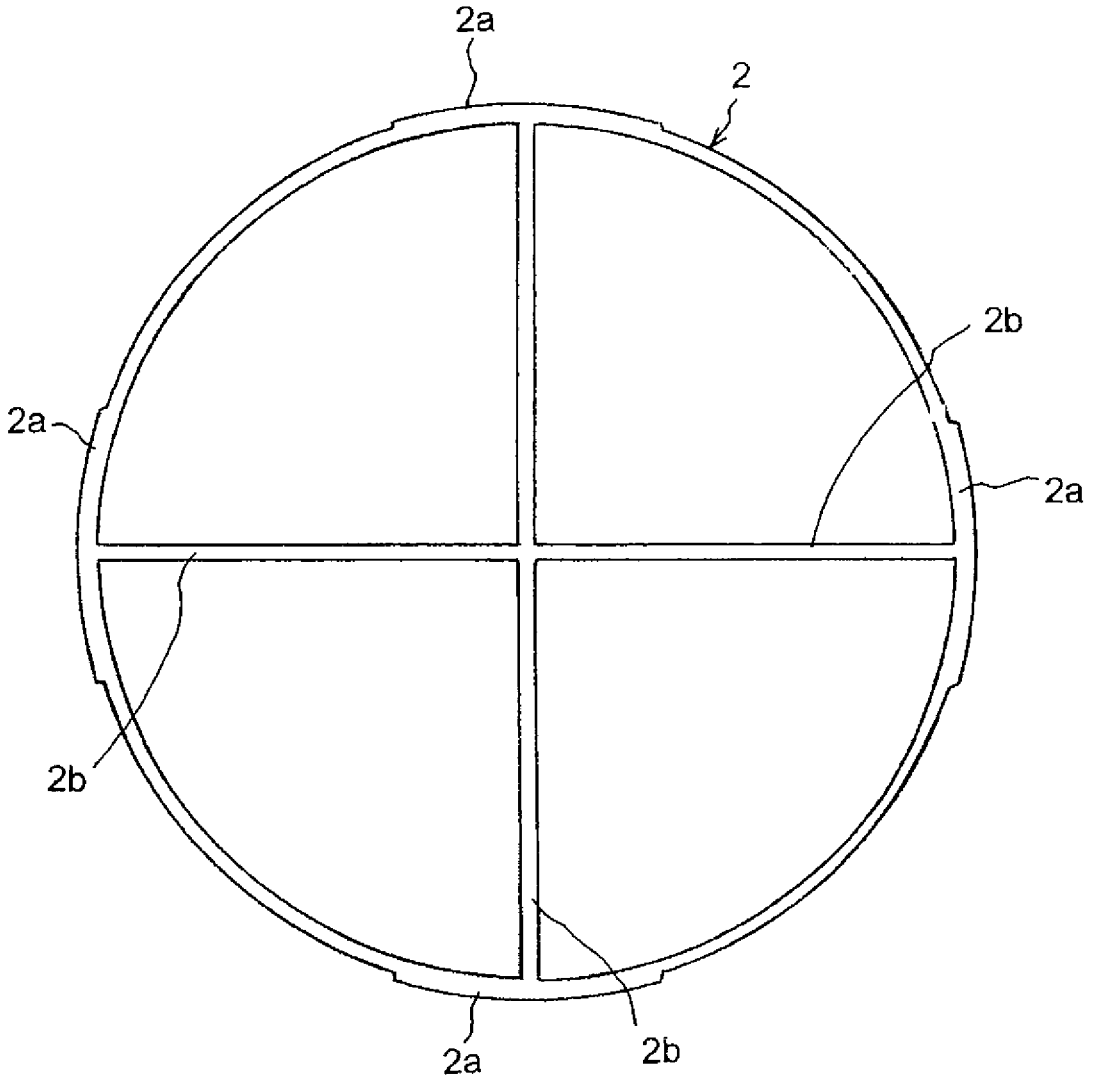
FIG. 7 is a plan view of a reinforcing plate according to the same conventional technology.

Fixing the splinter shield for a vacuum pump having the above-described configuration to the inlet port and operations of the splinter shield are described next with reference to FIG. 5. An outer edge of the rim 12*a* is provided with the locking parts 12*d* that stand in a standing manner at substantially right angles to the rim 12*a*. This rim 12*a* is inserted into a fixing groove 7 that is provided in a concave manner in an inner circumferential portion of the inlet port 4, and subsequently the retaining ring 8 is pushed into this fixing groove 7.

In so doing, the retaining ring 8 is pushed into the fixing groove 7 such that the gap formed in the notch 8*a* becomes narrow, resulting in an opening tendency. This opening tendency acts to further push the locking parts 12*d*, whereby the rim 12*a* with the locking parts 12*d* is strongly fastened to the fixing groove 7. The splinter shield 12 is fixed to the inlet port 4 by this aspect of fastening the rim 12*a* having the locking parts 12*d* to the fixing groove 7.

Furthermore, the strength of the splinter shield 12 itself is enhanced by integrally forming the wire netting portion 12*b* and the rib portion 12*c* for reinforcement in the splinter shield 12. Consequently, the splinter shield 12 can sufficiently be prevented from bending toward the inside of the pump and falling when air rushes into the pump through the inlet port 4.

As described above, four pairs of the locking parts 12*d* are formed at equal intervals in the circumferential edge portion of the splinter shield 12. These four pairs of locking parts 12*d* are pushed into and fastened to the fixing groove 7 by the retaining ring 8. In addition, the locking parts 12*d* are pushed into and fastened to the fixing groove 7 by the retaining ring 8, instead of pushing the locking parts 12*d* into the fixing groove 7 and the tightly coupling and fastening the locking parts 12*d* to the fixing groove 7. Therefore, the splinter shield 12 can easily be attached to or removed from the inlet port 4 by simple attachment or removal of the retaining ring 8.

As described above, in the splinter shield for a vacuum pump according to the present embodiment and the vacuum pump having such splinter shield, the splinter shield 12 is obtained as a single piece of sheet by integrally forming the wire netting portion 12*b* and the cross-shaped rib portion 12*c* for reinforcement, instead of obtaining a composite part in which a wire net and reinforcing plate are formed separately and superposed on each other. Thus, the splinter shield 12 has a required strength, and the costs thereof can be reduced.

The fastening strength of the splinter shield 12 to the fixing groove 7 can be enhanced sufficiently. As a result, the splinter shield 12 can be prevented from bending toward the inside of the pump and coming into contact with the equipment inside the pump such as the rotary vanes when air rushes into the pump through the inlet port 4. As a result, damage to the pump can be prevented, and the splinter shield 12 can be prevented from falling.

Because the present invention is not configured to push the locking parts 12*d* into the fixing groove 7 to tightly couple the locking parts 12*d* and the fixing groove 7 to each other, the locking parts 12*d* being provided in a standing manner at substantially right angles to the rim 12*a*, the splinter shield 12 can easily be attached to and removed from the inlet port 4.

Note that various modifications can be made to the present invention without departing from the spirit of the present invention, and it should be clearly understood that the present invention is intended to encompass such modifications.

INDUSTRIAL APPLICABILITY

The present invention can be applied widely to all types of gas intake mechanisms that need to be able to reduce costs of a splinter shield by obtaining a single sheet of splinter shield having a required strength and enhanced fastening strength to a fixing groove, to prevent the splinter shield from bending toward the inside of a gas intake mechanism and coming into contact with equipment inside the gas intake mechanism when air rushes into the gas intake mechanism through an inlet port, so that the splinter shield does not fall, and to facilitate attachment and removal of the splinter shield with respect to the inlet port.

What is claimed is:

1. A splinter shield for a vacuum pump in which a rim formed in a circumferential edge portion of the splinter shield is inserted into a fixing groove that is provided in a concave manner in an inner circumferential portion of an inlet port of the vacuum pump, and the splinter shield is provided in a tensioned manner to the inlet port by pushing a retaining ring into the fixing groove, wherein said splinter shield is made of metal, and, locking parts that are locked into the retaining ring are formed at intervals along the rim and are provided in a standing manner at substantially right angles to the rim, said locking parts are formed before inserting said splinter shield into said fixing groove, a space is provided between the fixing groove and a top of the locking parts, and the locking parts are pushed to and fastened to an inner peripheral wall of the fixing groove by an opening tendency of the retaining ring.

2. The splinter shield for a vacuum pump according to claim 1, comprising a wire netting portion and a rib portion for reinforcement disposed as a crosspiece within the rim, wherein the wire netting portion and the rib portion are integrally formed with a single sheet member.

3. A vacuum pump, comprising the splinter shield for a vacuum pump according to claim 1 or 2.

* * * * *